US005994996A

United States Patent [19]

Van Den Broek et al.

[11] Patent Number: 5,994,996

[45] Date of Patent: Nov. 30, 1999

[54] THIN-FILM RESISTOR AND RESISTANCE MATERIAL FOR A THIN-FILM RESISTOR

[75] Inventors: Jan J. Van Den Broek; Richard A. F. Van Der Rijt, both of Eindhoven, Netherlands

[73] Assignee: U.S. Philips Corporation, New York, N.Y.

[21] Appl. No.: 08/927,878

[22] Filed: Sep. 11, 1997

[30] Foreign Application Priority Data

Sep. 13, 1996 [EP] European Pat. Off. ..... 96202567

[51] Int. Cl.[6] ..... H01C 1/012

[52] U.S. Cl. ..... 338/308; 338/309; 338/313; 338/7; 252/521.3

[58] Field of Search ..... 338/306, 307, 338/308, 309, 7, 313; 252/521.2, 521.3

[56] References Cited

U.S. PATENT DOCUMENTS

| | | | |
|---|---|---|---|
| 2,662,957 | 12/1953 | Eisler | 338/308 |
| 3,203,830 | 8/1965 | Ostrander et al. | 338/308 |
| 3,607,386 | 9/1971 | Galla et al. | 338/308 |
| 3,621,567 | 11/1971 | Hasegawa et al. | 338/308 |
| 3,808,576 | 4/1974 | Castonguay et al. | 338/309 |
| 4,298,505 | 11/1981 | Dorfeld et al. | 338/308 |
| 5,235,313 | 8/1993 | Narizuka et al. | 338/308 |
| 5,258,738 | 11/1993 | Schat | 338/332 |
| 5,907,274 | 5/1999 | Kimura et al. | 338/309 |

OTHER PUBLICATIONS

Dummer, "Materials for Conductive and Resistive Functions" (Hayden Ser. in Mat. for Electrical & Electronic Design—Ed. A.E. Javitz) pp. 16–17 (1970). (No month). C:/892/ls/892_3.asc

*Primary Examiner*—Michael L. Gellner
*Assistant Examiner*—Karl Easthom
*Attorney, Agent, or Firm*—F. Brice Faller

[57] ABSTRACT

A metal alloy having an intrinsically low TCR, and which preferably comprises a metal oxide and forms part of the resistance material in a quantity of 15–60 vol. %. The best results are achieved with a resistance material which comprises an alloy of CuNi as the metal alloy and $SiO_2$ as the high-ohmic component. The resistors exhibit a relatively high resistance value as well as a relatively low TCR value.

6 Claims, 2 Drawing Sheets

THIN-FILM RESISTOR AND RESISTANCE MATERIAL FOR A THIN-FILM RESISTOR

BACKGROUND OF THE INVENTION

The invention relates to a thin-film resistor comprising a substrate which is provided with two connections which are electrically interconnected via a layer of a resistance material on the basis of a metal alloy having an intrinsically low TCR (temperature coefficent of resistance). The invention also relates to a sputtering target which can suitably be used to manufacture such a thin-film resistor.

Thin-film resistors based on metal alloys are known per se. These resistors include, more specifically, the so-called "precision resistors", which are resistors whose resistance value is accurately and readily reproducible. In general, the resistance material of this type of resistors is selected on the basis of binary and ternary metal alloys, such as CuNi, CrSi and NiCr(Al). These metal alloys are provided by means of sol-gel techniques, sputtering or vacuum evaporation. Dependent upon, inter alia, the exact composition and the thermal pre-treatment of these alloys, they exhibit a low TCR. The TCR of a resistor is to be understood to mean the relative change of the resistor as a function of temperature. The value of the TCR is customarily given in ppm/°C. Metal alloys having an intrinsically low TCR are metal alloys which, when they are in thermodynamic equilibrium, exhibit a TCR whose absolute value is smaller than 100 ppm/°C.

The known film resistors have several important drawbacks. For example, the composition of the binary or ternary metal alloy must be accurately selected in order to attain the intended, low TCR of the material. In the case of such an accurately selected composition, it is generally no longer possible to further adjust the sheet-resistance value and at the same time retain the low TCR value. In addition, the sheet resistance of said alloys proves to be relatively low. In the case of the above-mentioned alloys having a low TCR, the sheet resistance is of the order of 1 Ω/□ (CuNi), 1 kΩ/□ (CrSi) or 100 Ω/□ (NiCrAl).

SUMMARY OF THE INVENTION

It is an object of the invention to provide a film resistor which combines a relatively high, adjustable sheet resistance with a low TCR value. The invention also aims at providing a sputtering target which is suitable for the manufacture of such a thin-film resistor.

These and other objects of the invention are achieved by a film resistor of resistance material which also comprises a high-ohmic component.

Experiments leading to the present invention have shown that the presence of a high-ohmic component considerably increases the resistance value of the resistance material, while, surprisingly, the TCR value remains, at a relatively low level. It has further been found that the resistance value can be changed by subjecting the resistor to temperature treatments, while the intrinsically low TCR value surprisingly remains relatively low. For the metal alloys having an intrinsically low TCR value, binary alloys are found to be suitable. In particular binary alloys on the basis of AuPt, CuPd, AgMn and IrPt are satisfactory. Binary alloys on the basis of AgPd, AgMn and CuNi prove to be very suitable. It is noted that high-ohmic components are to be understood to mean in this context, compounds whose resistivity is at least a factor of 1000 higher than that of the metal alloy. Useful examples of such components are oxides and nitrides, such as $B_2O_3$, $Si_3N_4$, as well as suitable metal silicides. Preferably, the resistance material comprises those oxides, nitrates and metal silicides in nanocrystalline form.

An exact explanation of the effect found is not (yet) available. It is assumed that, in the resistance material, the metal alloy is present in the form of conductor tracks in the high-ohmic component. It seems that such tracks are formed during the thermal treatment carried out in the manufacture of the film resistor. The presence of these tracks provides the resistance material with the electric properties of the pure metal alloy, such as an intrinsically low TCR. The initially achieved high resistance value of the resistance material can be reduced by subjecting it to further temperature treatments. It has been found that said treatments (almost) do not affect the intrinsically low TCR. This phenomenon can be explained by assuming that the temperature treatment causes both the number and the thickness of the conductor tracks to increase.

The high-ohmic component can be a metal oxide. A favorable property of metal oxides is that they are very inert. Therefore, chemical reactions with the resistance alloy do not take place, even in the case of further temperature treatments of the film resistor in accordance with the invention, which are carried out at a relatively high temperature (above 400°C.). Metal oxides which are very suitable are the compounds $Al_2O_3$, ZnO, $SiO_2$ and $TiO_2$.

The resistance material preferably contains the high-ohmic component in a quantity ranging from 15 to 60 vol. %. In further experiments it has been found that it is impossible to form conductor tracks in the resistance material if the material contains the high-ohmic component in a quantity above 60 vol. %. This prohibits the manufacture of serviceable resistors. If the resistance material contains the high-ohmic component in a quantity below 15 vol. %, the resistance increases hardly, if at all. An optimum compromise between both undesirable phenomena is achieved if the resistance material contains the high-ohmic component in a quantity ranging from 25 to 50 vol. %.

The that for the metal alloy is preferably an alloy of CuNi, and for the high-ohmic component use is made of $SiO_2$. This combination of a metal alloy and a high-ohmic component provides the film resistor with a relatively high, adjustable resistance of 1000 Ω/□ and more in combination with a low TCR, which is low over a wide temperature range. This applies, in particular, to resistance materials on the basis of CuNi, which contain 65–70 at. % Cu and 30–35 at. % Ni.

The invention also relates to a sputtering target comprising a resistance material on the basis of a metal alloy having an intrinsically low TCR. This sputtering target is characterized in that the resistance material also comprises a high-ohmic component. Such a target in accordance with the invention can be obtained by mixing powders of the metal alloy and of the high-ohmic component in the desired ratio, whereafter the powders are compressed and sintered, for example at approximately 900°C. The compressing and sintering operations are preferably carried out simultaneously by means of a technique which is commonly referred to as "hot isostatic pressing" (HIP technique). The molded body thus formed can be used as a sputtering target to manufacture the above-mentioned film resistors in accordance with the invention.

DESCRIPTION OF THE PREFERRED EMBODIMENTS

Figure 1A:
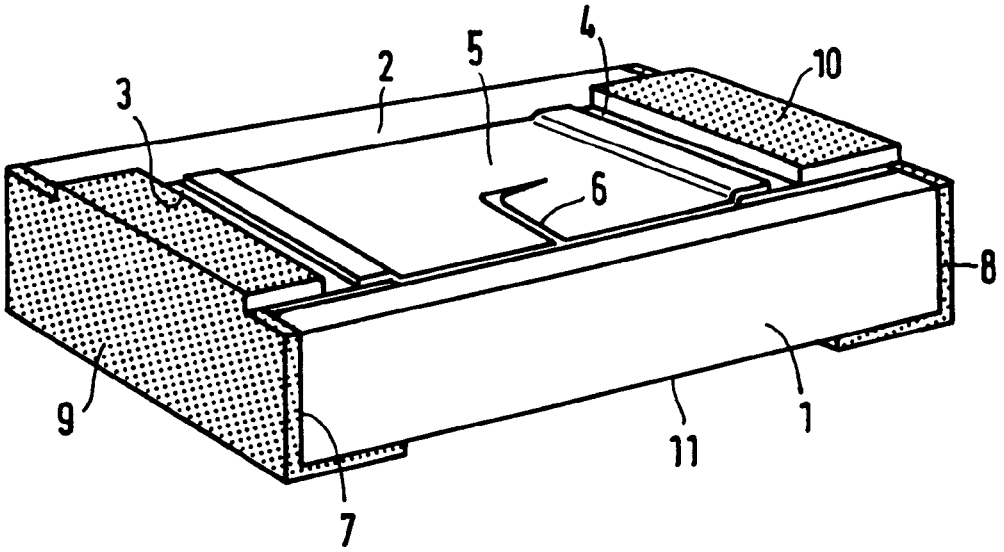
FIG. 1A is a schematic perspective of, a film resistor in accordance with the invention.
Figure 1B:
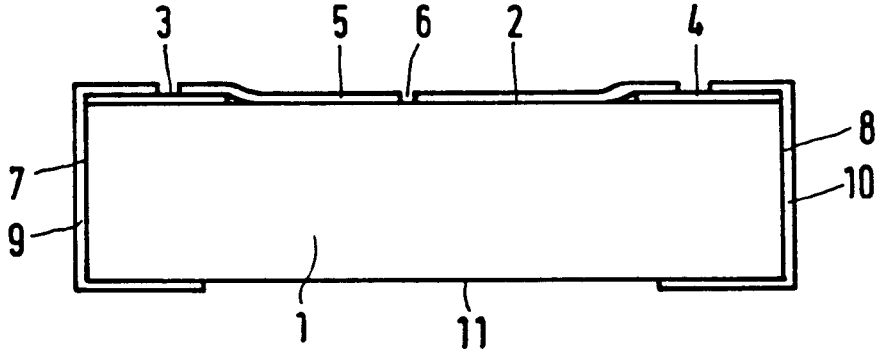
FIG. 1B is a schematic side view of the resistor.

Referring to FIG. 1A and 1B the film resistor comprises an electrically insulating substrate (1), preferably of a ceramic material, such as aluminium oxide. The dimensions of the substrate are 3.2×1.6×0.5 $mm^3$. Connections (3) and (4), which, in this case, are made of Au, are provided on two facing ends of a main surface (2) of the substrate. These connections are connected to each other via a layer (5) of a sputtered resistance material on the basis of a metal alloy having an intrinsically low TCR, the resistance material also comprising a high-ohmic component.

Depending on the intended resistance value, the layer thickness of the resistance layer (5) is chosen in the range between 10 and 200 nm. In this case, the thickness is approximately 100 nm. The resistor was brought to the desired resistance value, inter alia, by means of laser trimming. In this process, a trimming track (6) is formed. It is noted that the connections may be provided both underneath and on the resistance layer. It is further noted that an anti-diffusion layer, for example on the basis of an NiV alloy, is situated between the connections and the resistance layer.

The end faces (7, 8) of the substrate are further provided with end contacts (9) and (10), for example, of PbSn-solder. These end contacts electrically contact connections (3) and (4), extend as far as the second main surface (11) of the substrate and cover a small part thereof. When the resistor is provided, this part is electrically connected to conductor tracks which are situated on a printed circuit board. The end contacts are customarily provided by means of dip-coating. If necessary, the resistance layer may be provided with a protective coating (not shown), for example, of a lacquer.

Resistors of the above-described configuration are manufactured from a substrate plate which is lithographically provided, in succession, with a large number of sputtered or vacuum-evaporated resistance layers and connections. Subsequently, such a plate is broken along pre-formed grooves so as to form a number of rods, which are provided with end contacts at their fracture faces. Subsequently, rods are broken so as to form individual film resistors of the above-described type. This method of manufacturing is described in greater detail in U.S. Pat. No. 5,258,738, which relates to thick-film resistors. It is noted that, although the description of the invention relates to SMD-resistors and is extremely suitable for such resistors, the invention can alternatively be used in conventional wire resistors and MELF resistors.

In the above-described film resistor, a CuNi-based metal alloy containing $SiO_2$ as the high-ohmic component is used as the resistance material. The composition of the resistance material corresponds to the formula $(Cu_{68}Ni_{32})_{81}(SiO_2)_{19}$. The metal alloy is prepared by mixing 57 vol. % of a fine-grain $Cu_{68}Ni_{32}$-powder and 43 vol. % of a nanocrystalline powder of $SiO_2$. Subsequently, the mixture is hot-pressed (50 atm.) and sintered at approximately 900°C. A block of the resultant resistance material is used as the sputtering target in the manufacture of film resistors of the type described hereinabove.

Figure 2:
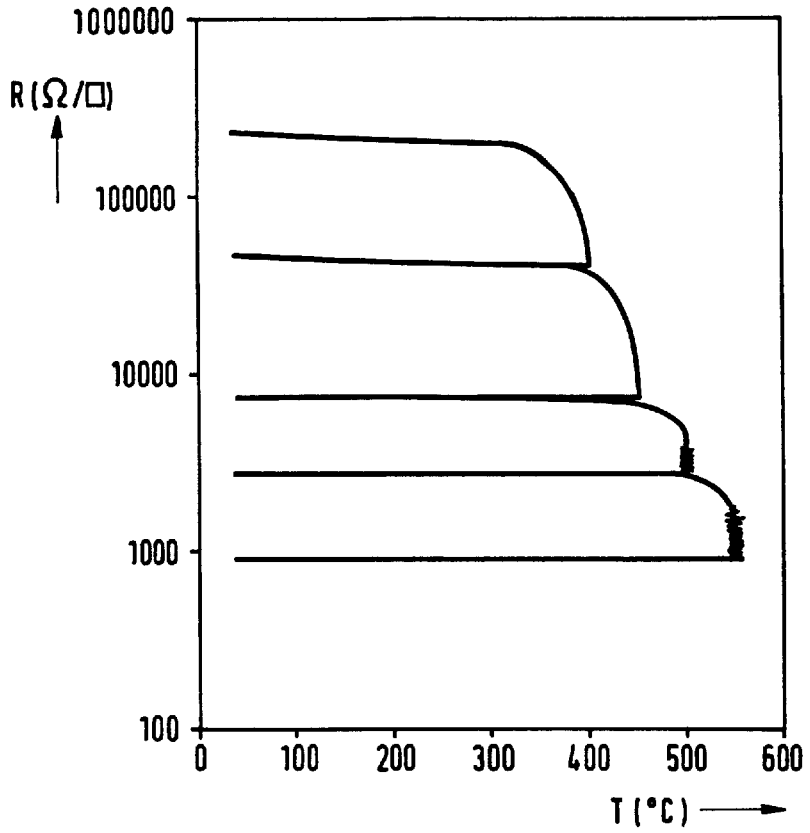
FIG. 2 shows a graph in which the resistance value of a thin-film resistor in accordance with the invention is plotted as a function of a thermal-treatment temperature.
Figure 3:
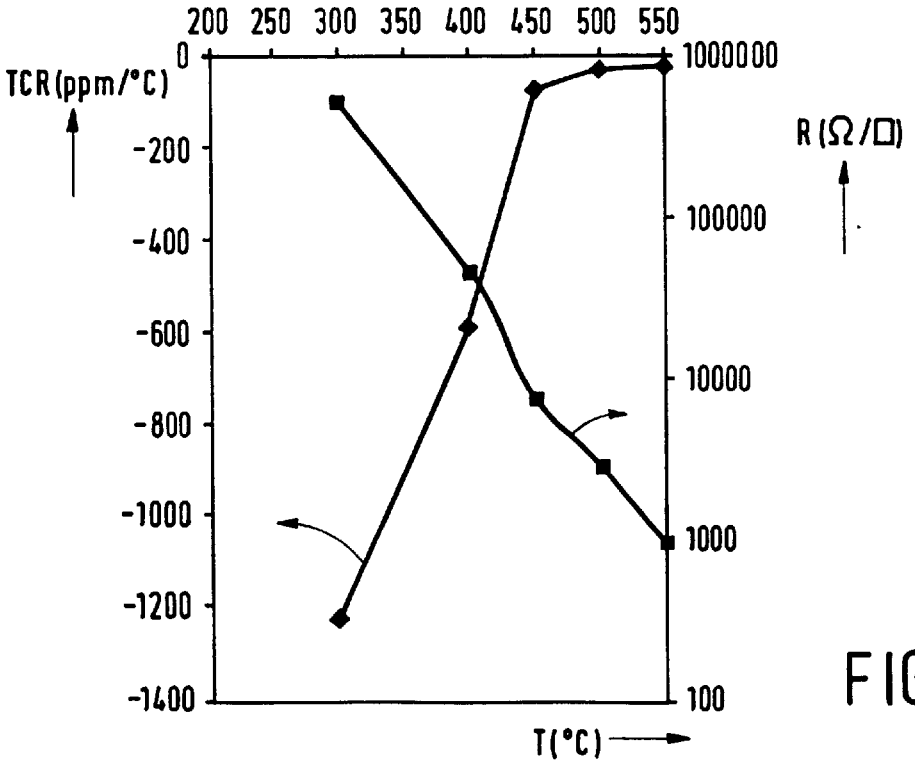
FIG. 3 shows a graph in which these values are plotted in a different manner.

The resistance value and the TCR of a film resistor in accordance with the invention are measured as a function of the thermal treatment. The thickness of the resistance layer of the resistor measured is approximately 100 nm. Table 1 lists the resistance and the TCR values, as a function of the treatment temperature. Each temperature treatment lasts 20 minutes. The data of Table 1 are graphically shown in FIGS. 2 and 3. In FIG. 2, the change of the sheet resistance of the resistor is shown as a function of thermal treatments at 300, 400, 450, 500 and 550°C., respectively. FIG. 3 graphically shows the resistance value and the TCR value resulting from these thermal treatments.

TABLE

| T(° C.) | TCR (ppm/° C.) | R(Ω/□) |
|---|---|---|
| 300 | −1224 | 511533 |
| 400 | −584 | 46668 |
| 450 | −76 | 7443 |
| 500 | −29 | 2773 |
| 550 | −23 | 898 |

The Table and the figures show that the addition of a high-ohmic component to a resistance alloy leads to a substantial increase of the resistance value. A layer of comparable dimensions of $Cu_{68}Ni_{32}$ without a high-ohmic component has a sheet resistance of approximately 10 Ω/□. By means of a temperature treatment, the initially relatively high negative TCR can be reduced to values ranging between −100 and +100 ppm/°C. It has been found that further temperature treatments at higher temperatures cause the TCR of the resistance material to approach more or less asymptotically a value of 0 ppm/°C. Consequently, further treatments at higher temperatures hardly influence the low TCR value. The resistance value, however, does change as a result of such treatments at a higher temperature. This special effect has the important advantage that the resistance of the material in accordance with the invention can be adjusted at will, while the TCR remains relatively low.

We claim:

1. A thin-film resistor comprising an electrically insulating substrate, a pair of spaced apart connections on said substrate, and a layer of resistance material electrically connecting said connections on said substrate, said material comprising a metal alloy of CuNi having a TCR of less than 100 ppm/°C., wherein said CuNi alloy consists essentially of 65–70 at.% Cu and 30–35 at. % Ni, and further comprising 15 to 60 vol.% $SiO_2$.

2. A thin film resistor as in claim 1 wherein said resistance material comprises 25–50 vol.% $SiO_2$.

3. A thin film resistor as in claim 1 wherein said alloy of CuNi has the formula $(Cu_{68}Ni_{32})_{81}(SiO_2)_{19}$.

4. A thin film resistor as in claim 1 wherein said resistance material consists essentially of said metal alloy of CuNi and $SiO_2$.

5. A thin film resistor as in claim 4 wherein said resistance material comprises 25 to 50 vol.% $SiO_2$.

6. A thin film resistor as in claim 4 wherein said alloy of CuNi has the formula $(Cu_{68}Ni_{32})_{81}(SiO_2)_{19}$.

* * * * *